United States Patent [19]

Moore

[11] 4,147,353

[45] Apr. 3, 1979

[54] SOCCER RETRIEVER

[76] Inventor: Jerrell O. Moore, 1807 Glenfield, Dallas, Tex. 75224

[21] Appl. No.: 754,898

[22] Filed: Mar. 16, 1977

[51] Int. Cl.[2] ..... A63B 69/00; A63B 43/00

[52] U.S. Cl. ..... 273/95 A; 273/58 C

[58] Field of Search ..... 273/95 R, 95 A, 97 R, 273/98, 58 C, 200 R

[56] References Cited

U.S. PATENT DOCUMENTS

| | | | |
|---|---|---|---|
| 2,243,620 | 5/1941 | Fernandez | 273/95 A X |
| 3,297,321 | 1/1967 | Kuhnes et al. | 273/95 A X |
| 3,351,343 | 11/1967 | Papp | 273/58 C |
| 3,804,409 | 4/1974 | Schachner | 273/95 A X |

FOREIGN PATENT DOCUMENTS

| | | | |
|---|---|---|---|
| 1162827 | 4/1958 | France | 273/95 A |
| 7032173 | 4/1972 | France | 273/95 A |
| 838470 | 6/1960 | United Kingdom | 273/95 A |

*Primary Examiner*—William H. Grieb

*Attorney, Agent, or Firm*—Hubbard, Thurman, Turner, Tucker & Glaser

[57] ABSTRACT

An apparatus for holding and retrieving a game ball includes a suitable anchor with a cord attached to the anchor at one end and an adjustable ball holder attached to the other end of the cord. The adjustable ball holder has four elongated pieces of webbing material that are joined together at one end so that the pieces extend outwardly at right angles between each adjacent piece of webbing material. The webbing material pieces are sized to extend around a game ball with the upper free ends of the webbing being attached to the other end of the elongated cord to thereby hold the ball in place. A continuous elastic strip is attached to the mid-point of each of the webbing material pieces to thereby surround the ball held in place to allow balls of different sizes to be held within the ball holder.

4 Claims, 10 Drawing Figures

SOCCER RETRIEVER

SUMMARY OF THE INVENTION

This invention relates to a game ball holder to hold and retrieve a game ball as it is kicked. In another aspect, this invention relates to a game ball holder and retrieving apparatus. It can be utilized to hold and secure game balls of different sizes.

In these days with limited space, a lot of people living in complexes, especially kids in the city, do not have anywhere to play. When the children play with game balls, such as soccer balls, it is desirable to keep the child from running into the street after the ball. It is also desirable to keep the child from breaking out windows and denting out cars with a game ball, such as a soccer ball.

It is an object of this invention to provide an apparatus for holding and retrieving game balls. It is another object of this invention to provide an apparatus for holding game balls of differing sizes.

This invention is, therefore, an apparatus for holding and retrieving a game ball. The invention includes an anchor means with one end of an elongated cord attached to the anchor means. The other end of the cord is attached to an adjustable ball holder for receiving and holding the game ball. The adjustable ball holder includes four equal length elongated pieces of webbing material that are joined together at one end whereby the pieces of webbing material extend outwardly and are at right angles to each adjacent piece of webbing material. The pieces of webbing material are of sufficient length to partially extend around a ball. A continuous elastic strip is affixed to the mid-point of each of the four pieces of webbing material and is sized to allow balls of differing diameters to be held within the ball holder. The upper end of each of the four pieces of webbing material are attached to the other end of the cord member.

DESCRIPTION OF THE PREFERRED EMBODIMENTS

Figure 10:
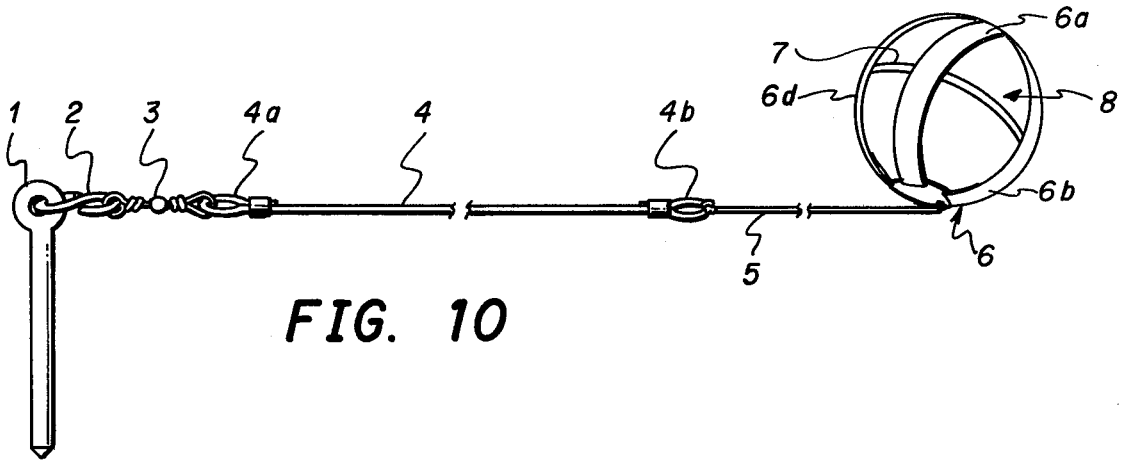
FIG. 10 is a perspective view showing the entire assembly of components of the instant invention with a ball held in place in the ball holder.

The preferred embodiments of this invention can best be described by referring to the drawings.

Figure 1:
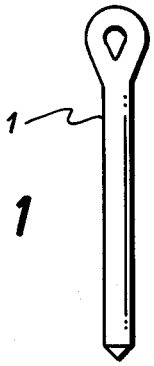
FIG. 1 is a perspective view of one anchor use in this invention.

As shown in FIG. 1, a red tent stake 1 is made of cycolac, 4" long to anchor in the ground.

Figure 2:
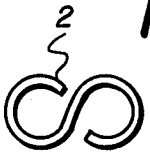
FIG. 2 is a perspective view of a hook utilized as a portion of this invention.

As shown in FIG. 2, an "S" shaped metal hook 2, size 2⅛" made of ⅛" material, connects anchor 1 and swivel 3.

Figure 3:
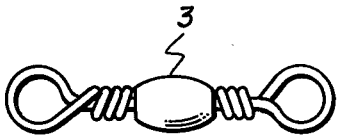
FIG. 3 is a perspective view of a swivel utilized for assembling this invention.

As shown in FIG. 3, a brass swivel 3, size 5/0, connects hook 2 and elongated cord 4 to prevent the cord from twisting.

Figure 4:
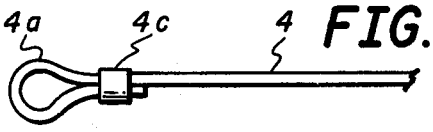
FIG. 4 is a side-elevational view of one end of an elongated cord utilized in this invention.

As shown in FIG. 4, elongated cord 4 is a "121¼" diameter single cover elastic shock cord, 10' for bigger boys and 6' for pee wee size. It stretches 2 to 3 feet longer when it is kicked. Loops **4*a* and 4*b* are formed at both ends and held in place by two metal closing clamps 4*c* on each end. The clamps 4*c* and the loose ends of cord 4 are covered by a strip of 1" wide vinyl tape.**

Figure 5:
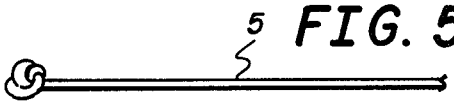
FIG. 5 is a perspective view of one end of a braided nylon cord member utilized in this invention.
Figure 6:
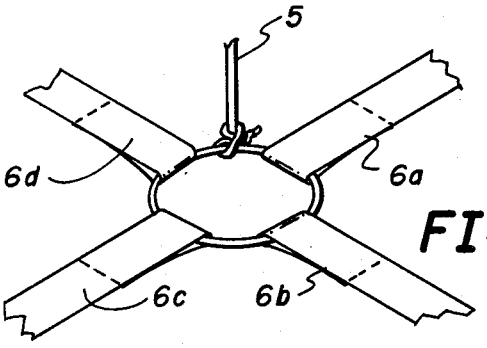
FIG. 6 is a perspective view showing the closure of the top end of the ball holder of the instant invention.

As shown in FIG. 5, a braided nylon cord 5, size ⅛" has one end which goes through loop **4*b* and is tied and taped. The other end goes through the apparatus on the ball in each of the four openings at the mouth of ball holder 6 and is tied and taped. By shortening elongated cord 4** it gives a better rebound. When shooting penalty goals the cord is shortened to half the distance of the penalty shot.

As shown in FIGS. 6, 8, 9 and 10, ball holder 6 is made from two pieces of 1¼" red cotton webbing, cut 25" and sewed together at the center to form a cross. Each of the four straps **6*a*, 6*b*, 6*c* and 6*d* is turned under 1½" and sewed with heavy duty thread to form a loop at the free end of the straps. The braided nylon cord 5, is then strung through each loop to form a ring, then tied to main cord 4** and taped.

Figure 7:
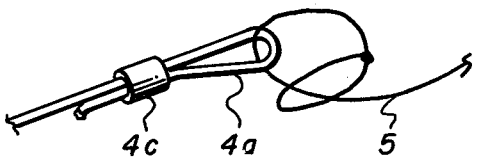
FIG. 7 is a perspective view showing the attachment of the braided cord to the elongated elastic shock cord of the instant invention.

As shown in FIG. 7, the connection of elongated cord 4 and braided cord 5 is made by forming a loop in one end of braided cord 5. One end of braided cord 5 is put through the loop on elongated cord 4 and then through the loop on braided cord 5 and pulled tight.

Figure 8:
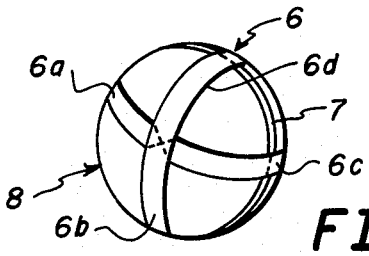
FIG. 8 is a perspective view showing the bottom of the ball holder apparatus of this invention with a ball contained therein.

As shown in FIG. 8, the bottom of the ball holder apparatus 6 is formed by two pieces of webbing which are crossed at the center and sewed with heavy duty thread. Halfway up the side of each of the four straps **6*a*, 6*b*, 6*c* and 6*d* is ½" elastic band 7 sewed to each strap to go around ball 8** to make it adjustable to any standard ball.

Figure 9:
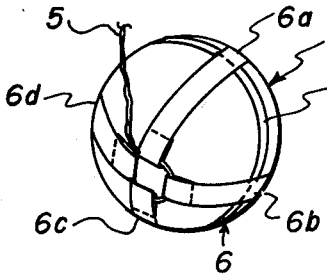
FIG. 9 is a perspective view showing the top of the ball holder apparatus of this invention with a ball contained therein.

As shown in FIG. 9, elastic band 7 passes around ball 8, and braided nylon cord 5 passes through the loops in the ends of each of the four straps **6*a*, 6*b*, 6*c* and 6*d***.

The entire assembly of components making up my invention is illustrated in FIG. 10.

I claim:

1. An apparatus for holding and retrieving a game ball comprising:

(a) an anchor means;

(b) an elongated cord member having a first end and a second end;

(c) means to affix the first end of said cord member to said anchor means;

(d) an adjustable ball holder for receiving and holding said game ball, said adjustable ball holder including four equal length elongated pieces of webbing material having a first end and a second end, said pieces being secured at their first ends, whereby each of said four elongated pieces of webbing material extend outwardly at right angles from each adjacent piece with the length of said elongated pieces being sufficient to reach partially around said ball, said adjustable ball holder further including a continuous elastic band member affixed to the mid-point of each of said four elongated pieces of webbing materials, said continuous elastic band member being sized to adjustably surround playing balls of differing sizes; and (e) means to affix the second ends of said four elongated pieces of webbing material to the second end of said cord member.

2. The apparatus of claim 1 wherein said elongated cord member is an elastic elongated cord member.

3. The apparatus of claim 1 wherein said means to affix said second ends of said four elongated pieces of webbing material to the second end of said cord member include loops in said second ends of said four elongated pieces of webbing material with a second cord being passed through each of said loops with said second cord being tied to said elongated member.

4. The apparatus of claim 1 wherein said four elongated pieces of webbing material are formed by sewing two equal length pieces of webbing material together at their mid-points.

* * * * *